US006261133B1

(12) United States Patent
Kubo et al.

(10) Patent No.: US 6,261,133 B1
(45) Date of Patent: Jul. 17, 2001

(54) CONNECTOR

(75) Inventors: Akinobu Kubo, Yokkaichi (JP); Julio Cesar Vargas, Braunschweig (DE)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/518,663

(22) Filed: Mar. 3, 2000

(30) Foreign Application Priority Data

Mar. 3, 1999 (JP) ..... 11-056093

(51) Int. Cl.[7] ..... H01R 13/514; H01R 13/40
(52) U.S. Cl. ..... 439/752; 439/733.1; 439/595
(58) Field of Search ..... 439/752, 595, 439/733.1

(56) References Cited

U.S. PATENT DOCUMENTS

| | | | | |
|---|---|---|---|---|
| 4,944,688 | * | 7/1990 | Lundergan | 439/275 |
| 5,167,534 | | 12/1992 | Ohsumi . | |
| 5,437,565 | * | 8/1995 | Atsumi et al. | 439/752 |
| 5,464,356 | * | 11/1995 | Nebeshima et al. | 439/752 |
| 5,474,477 | * | 12/1995 | Aoyama | 439/752 |
| 5,516,308 | * | 5/1996 | Yamanashi | 439/752 |
| 5,738,551 | * | 4/1998 | Matsuoka | 439/752 |
| 5,755,600 | * | 5/1998 | Yoshida | 439/752 |
| 5,997,364 | * | 12/1999 | Matsuoka et al. | 439/752 |
| 6,036,552 | * | 3/2000 | Atsumi | 439/752 |
| 6,062,906 | * | 5/2000 | Tanaka | 439/595 |

FOREIGN PATENT DOCUMENTS

| | | |
|---|---|---|
| 3705739 | 2/1987 | (DE) . |
| 295 09 311 U | 6/1995 | (DE) . |
| 0 624 922 | 4/1994 | (EP) . |
| 0 678 937 | 3/1995 | (EP) . |
| 2 255 864 | 11/1992 | (GB) . |

* cited by examiner

*Primary Examiner*—Paula Bradley
*Assistant Examiner*—Edwin A. León
(74) *Attorney, Agent, or Firm*—Anthony J. Casella; Gerald E. Hespos; Michael J. Porco

(57) ABSTRACT

In installing a retainer (20) on a connector housing (10), a guide portion (21A) formed on a removal prevention portion (21) fits in the connector housing (10) before a holding piece (22) reaches the connector housing (10). In this manner, the retainer (20) is placed in position. Therefore, it does not occur that the front end of the holding piece strikes against the outer surface of the connector housing. Consequently, it is possible to prevent the holding piece (22) from striking against the connector housing (10) and thus prevent it from being deformed or damaged. In the state where the retainer (20) has been locked at the locking position, the guide portion (21A) penetrates through the connector housing (10) and substantially contacts the seal ring (13), thus preventing the removal of the seal ring (13). Thus, it is possible to reliably prevent the removal of the seal ring (13) by the guide portion (21A) without providing the connector housing (10) with a removal prevention component part separately from the guide portion (21A).

9 Claims, 7 Drawing Sheets

CONNECTOR

BACKGROUND OF THE INVENTION

1. Field of the Invention

The present invention relates to a connector with a terminal fitting and a retainer to prevent removal of the terminal fitting.

2. Description of the Related Art

A prior art connector with a retainer to prevent removal of a terminal is disclosed in DE-A-3705739. This prior art connector includes opposite front and rear ends. A terminal is inserted into the rear end of the prior art connector housing, and a retainer is installed into a side of the connector housing. The retainer includes an arm-shaped holding piece, and the holding piece includes a projection. The retainer is held at a predetermined position by mounting the holding piece along an outer surface of the connector housing. In the retainer-mounted state, the projection is locked to the terminal and prevents removal of the terminal.

The holding piece of the retainer of this prior art connector is exposed to the outer surface of the connector housing. Thus, there is a possibility that component parts may interfere with the holding piece. Additionally, the projection that prevents removal of the terminal is formed at the front end of the holding piece. Therefore, the interference from the component parts can affect the removal projection. In this case, there is a possibility that the projection may be dislocated in a direction that enables removal from the terminal. Thus, the prior art connector is not reliable in this respect.

To solve the above-described problem, it is conceivable to form the removal prevention projection independently of the holding piece. The removal prevention projection then could be fit into the connector housing. In this case, the removal prevention projection would project in the direction in which it is assembled on the connector housing, similarly to the holding piece. However, such a configuration may cause the holding piece to be deformed or damaged when the front end of the holding piece strikes against the outer surface of the prior art connector housing.

A very thick and wide holding piece could be sufficiently rigid to avoid damage. In this case, however, the holding piece would project significantly from the outer surface of the connector housing, and hence would not comply with a demand for a compact connector.

The present invention has been made in view of the above-described situation, and it is an object of the present invention to provide a connector having an improved operability.

SUMMARY OF THE INVENTION

The subject invention is directed to a connector that prevents a retainer from deforming when the retainer is installed on a connector housing.

According to the invention, there is provided a connector comprising a connector housing into which at least one terminal can be inserted. The connector also includes a retainer that can be installed on the connector housing to prevent removal of the terminal. The retainer has a removal prevention portion that can be inserted into the connector housing and locked to the terminal. A holding piece can be installed on the connector housing to hold the retainer at a predetermined installing position. A guide portion is formed at a front end of the removal prevention portion, and projects forwardly from an extended end of the holding piece in the direction in which the retainer is installed on the connector housing.

According to a preferred embodiment, the holding piece is cantilevered and extends in a direction in which the retainer is installed on the connector housing.

Preferably, the holding piece can be installed along an outer surface of the connector housing.

Most preferably, the at least one terminal can be inserted from a rear side of the connector housing.

According to a further preferred embodiment, there is provided a connector comprising a connector housing with opposite front and rear ends. A terminal may be inserted into the rear end of the connector housing, and a retainer may be installed on a side surface of the connector housing to prevent removal of the terminal. The retainer has a removal prevention portion inserted into the connector housing and locked to the terminal. A holding piece is formed in the shape of a cantilever, and extends in a direction in which the retainer is installed on the connector housing. More particularly, the holding piece is installed along an outer surface of the connector housing, and holds the retainer at a predetermined installing position. A guide portion is formed at a front end of the removal prevention portion and projects forwardly from an extended end of the holding piece in the direction in which the retainer is installed on the connector housing.

A waterproof seal ring may be installed on a periphery of the connector housing, and preferably on a body of the connector housing. The retainer is installed on the connector housing such that a guide portion of the retainer penetrates through the connector housing. In particular, the guide portion projects to a position on the body of the connector housing for preventing removal of the seal ring.

The retainer is installed on the connector housing, by urging the guide portion at the front end of the removal prevention portion into the connector housing before the holding piece reaches the outer surface of the connector housing. In this manner, the removal prevention portion and the holding piece are placed in position. Therefore, the front end of the holding piece does not strike against the outer surface of the connector housing. Consequently, it is possible to prevent the holding piece from being deformed or damaged.

The guide portion of the retainer prevents the removal of the seal ring. Thus, it is possible to use a smaller number of components than a connector that requires a removal prevention means to be separate from the guide portion.

According to the invention, there is further provided a connector comprising a connector housing into which at least one terminal can be inserted. A retainer can be installed on the connector housing to prevent removal of the terminal. The retainer has a removal prevention portion that can be inserted into the connector housing and locked to the terminal by means of at least one locking portion. The locking portion comprises a guide surface arranged at an angle different from 0° or 180° with respect to an insertion/removal direction of the terminal for engaging a receiving surface of the terminal while the retainer is being moved to its locking position. Thus, the retainer presses the terminal in its insertion direction.

According to a preferred embodiment, the retainer can be inserted into a retainer installation hole. The size relationship between the terminal and the cavity is so set that when the terminal reaches a predetermined primary locking position the receiving surface is located inside the retainer installing hole.

Preferably, an inclination range of the terminal on the guide surface of the retainer is set to cover the movable range of the receiving surface based on the accumulated size tolerances of each of the connector housing, the retainer, the terminal and the cavity.

The locking portion preferably comprises a contact surface for engaging the terminal while the retainer is being moved to its locking position and when the terminal is insufficiently inserted, in particular when the receiving surface of the terminal is located rearward from an inclination range the guide surface.

These and other objects, features and advantages of the present invention will become more apparent upon a reading of the following detailed description and accompanying drawings.

DETAILED DESCRIPTION OF THE PREFERRED EMBODIMENT

An embodiment of the present invention is described below with reference to FIGS. 1 through 12. The connector of the embodiment comprises a connector housing 10 and a retainer 20.

Figure 6:
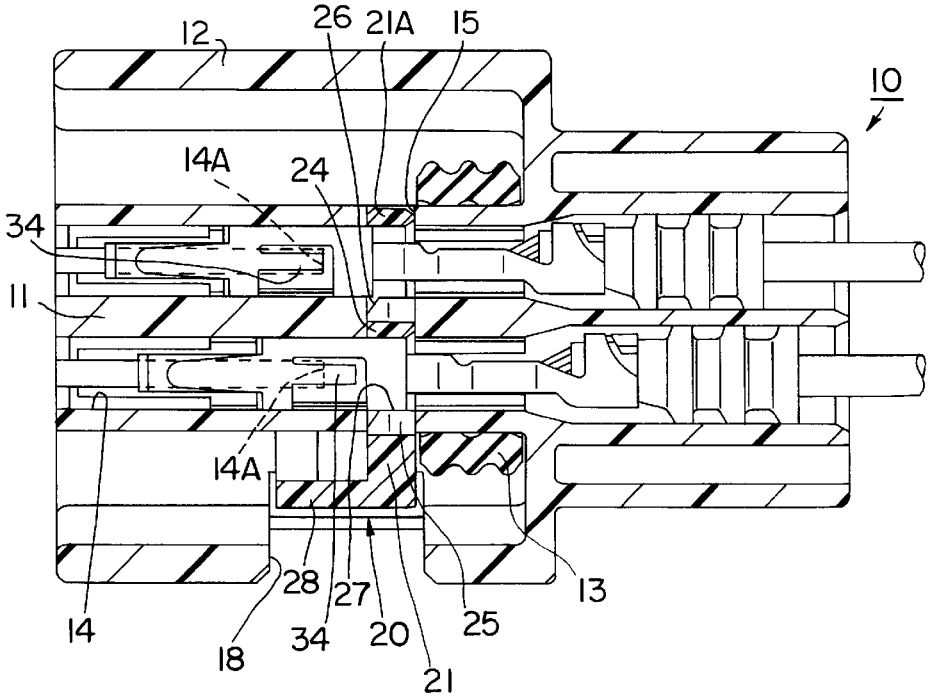
FIG. 6 is a vertical sectional view showing a state in which the retainer is temporarily locked.
Figure 7:
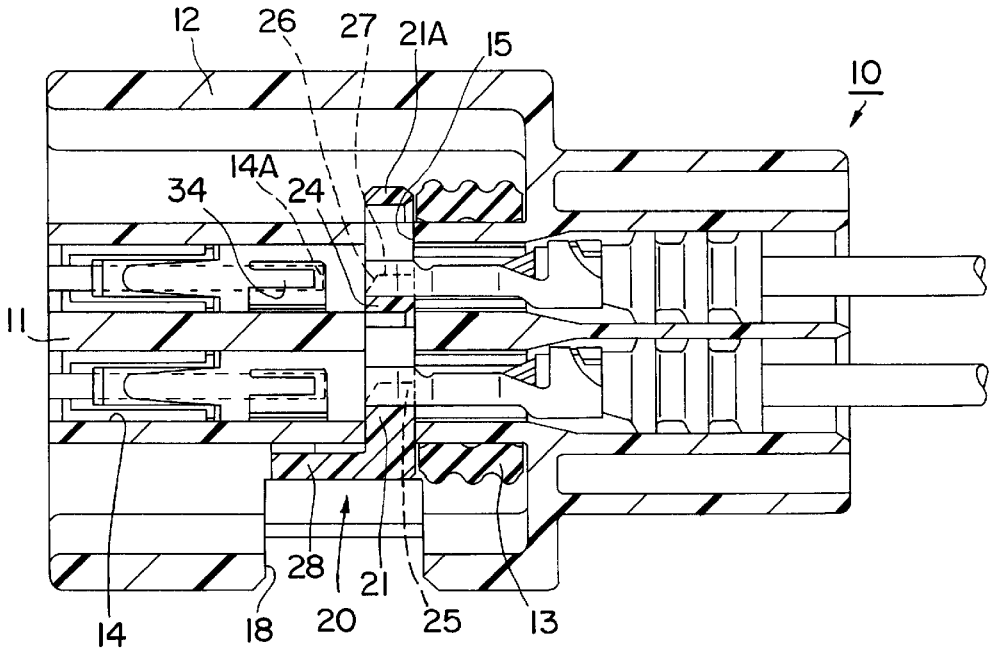
FIG. 7 is a transverse sectional view showing a state in which the retainer is locked.

The connector housing 10 has an elongated body 11 with opposite front and rear ends. A cylindrical hood 12 surrounds most of the front end of the body 11, and includes an open front and a closed rear, as shown in FIGS. 6 and 7. A seal ring 13 is inserted into the open front end of the hood 12 and is moved substantially to the closed rear end of the hood 12. Additionally the seal ring 13 is installed in a front to rear direction to surround the periphery of the body 11. The seal ring 13 waterproofs a fit-in portion between the connector housing 10 and a mating connector housing. The body 11 has a plurality of hollow cavities 14, and terminals 30 can be inserted at least partially into the respective cavities 14 from the rear. Each terminal 30 includes a lance 34 that can be locked to a receiving portion 14A of the cavity 14 to lock the terminal 30 primarily or in a first position.

A slit-shaped retainer installation hole 15 is formed on the body 11. The retainer installation hole 15 penetrates transversely through the body 11 from one outer side surface of the body 11 to the other side surface thereof. The opening of the retainer installation hole 15 on the outer surface of the body 11 is located to align with the front edge of the seal ring 13. Guide grooves 16 are formed on the upper and lower surfaces of the body 11 at locations forwardly of the seal ring 13, and function to guide holding pieces 22 of the retainer 20. A locking projection 17 is formed on each guide groove 16 for locking the retainer 20 to a temporary or first locking position and a final or second locking position.

A retainer insertion hole 18 is formed on the hood part 12, and aligns with the opening of the retainer installation hole 15 at one side surface of the body 11. The retainer insertion hole 18 in the hood 12 differs from the retainer insertion hole 15 of the body 11, in that the retainer insertion hole 18 of the hood 12 is not slit-shaped, but is rectangular and open widely along its length.

The retainer 20 is made, for example, of synthetic resin, and has a removal prevention portion 21 and a pair of holding pieces 22. The removal prevention portion 21 is thick, substantially rectangular and comparatively rigid. Additionally, the removal prevention portion 21 can be fitted tightly in and removed from the retainer installation hole 15. Holes 23 are formed in the removal prevention portion 21, and define a pattern that substantially corresponds with the pattern of the respective cavities 14. As a result, the terminals 30 can penetrate through the holes 23 of the removal prevention portion 21. A part of the edge of each hole 23 serves as a locking portion 24, and can be locked to a receiving surface 31 of the terminal 30 inserted into the cavity 14 normally to a predetermined position. The hole 23 substantially aligns with the cavity 14 in the state of FIG. 6 where the retainer 20 is temporarily locked to the connector housing 10. Thus, the terminal 30 can be inserted into the cavity 14 when the retainer 20 is in the temporarily locked position of FIG. 6. Conversely, the locking portion 24 of the hole 23 penetrates into the cavity 14 when the retainer 20 is locked at the locking position of FIG. 7, and the locking portion 24 is locked to the receiving surface 31 of the terminal 30. Thus, the terminal 30 is locked and cannot be removed.

Figure 8:
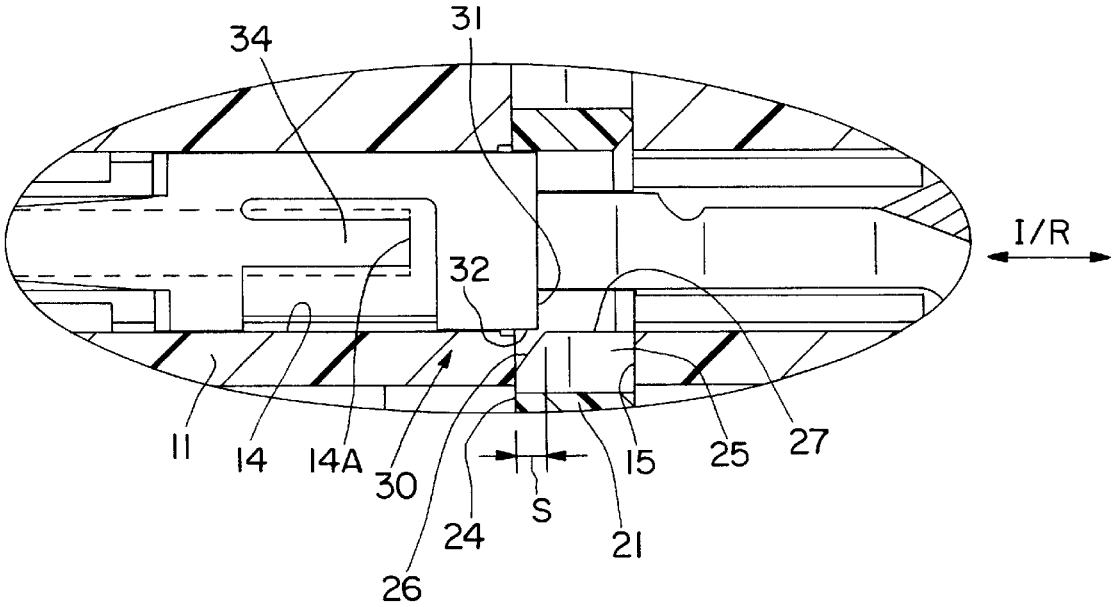
FIG. 8 is a partly enlarged vertical sectional view showing a state in which the retainer is temporarily locked.
Figure 9:
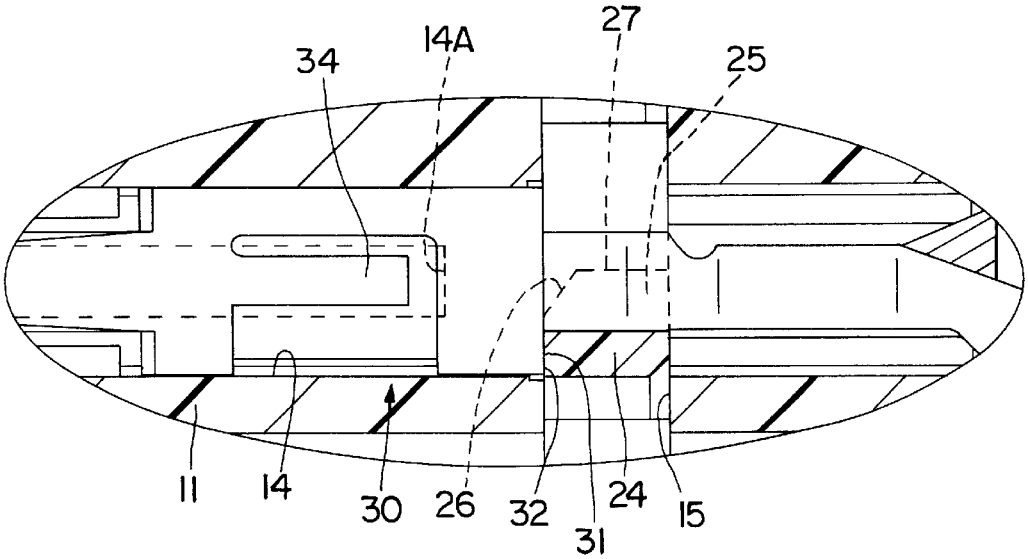
FIG. 9 is a partly enlarged vertical sectional view showing a state in which the retainer is locked.
Figure 10:
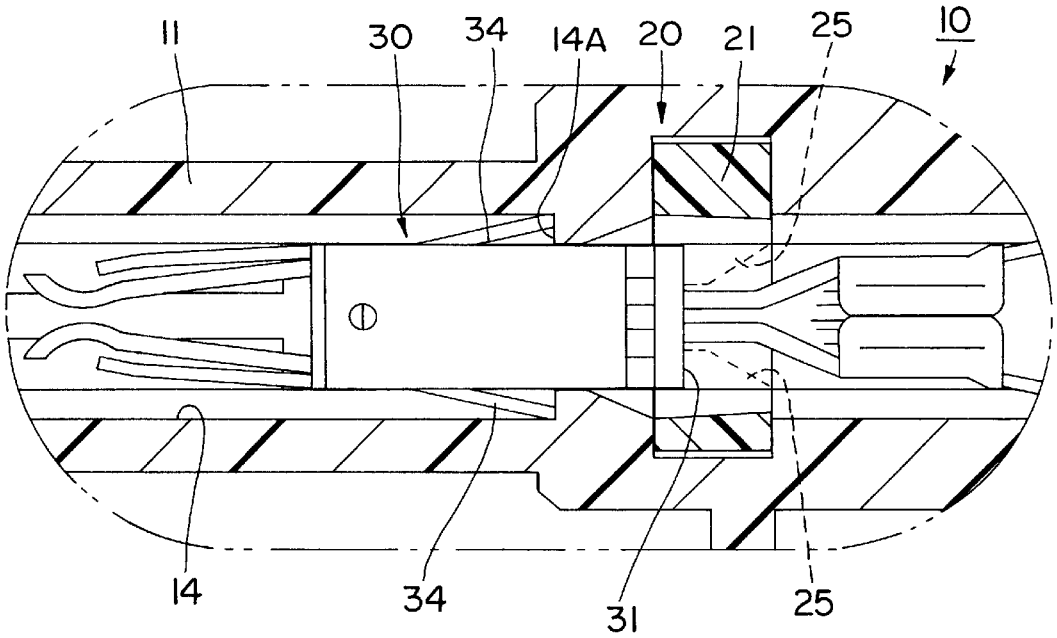
FIG. 10 is a partly enlarged horizontal sectional view showing a state in which a terminal is locked primarily.
Figure 11:
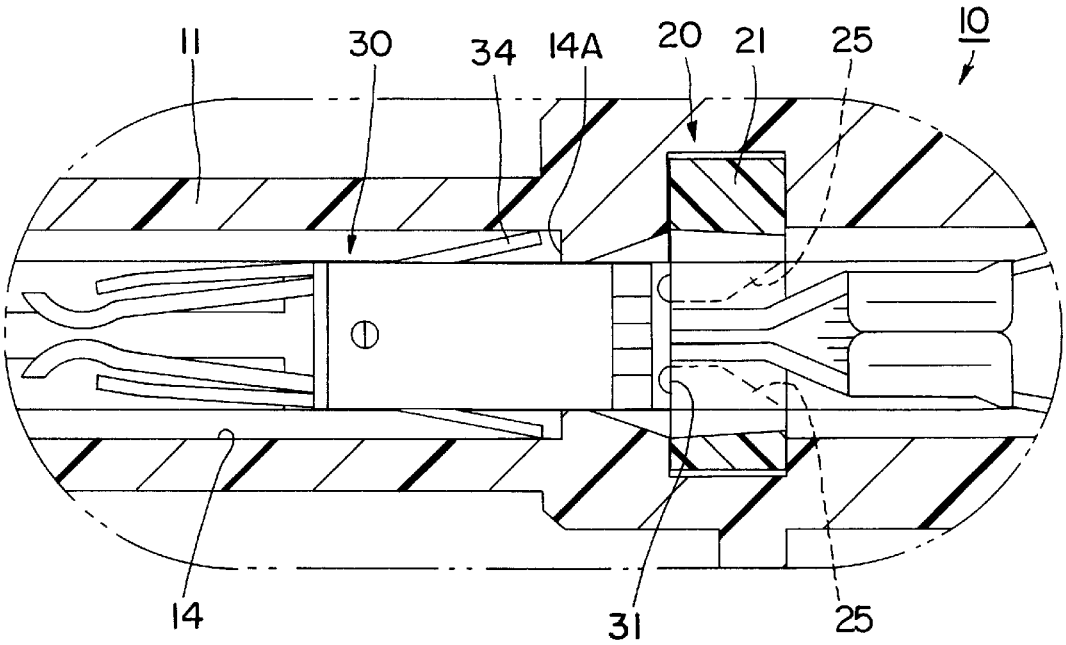
FIG. 11 is a partly enlarged horizontal sectional view showing a state in which the terminal is pressed to a position deeper than a first locking position.

A projection portion 25 is formed on the locking portion 24, as shown in FIGS. 8 and 9. The projection portion 25 includes a guide surface 26 inclined at an angle different from 0° or 180° with respect to the insertion/removal direction I/R of the terminal 30. A contact surface 27 continues from the rear of the guide surface 26, and is substantially parallel with insertion/removal direction I/R of the terminal 30. The guide surface 26 retracts outside an insertion/removal path of the terminal 30 when the retainer 20 is locked at the temporary locking position. The guide surface 26 engages an edge 32 of the receiving surface 31 when the terminal 30 is not fully inserted, and while the retainer 20 is being moved to the locking position. Thus the guide surface 26 presses the terminal 30 in the insertion direction. The size relationship between the terminal 30 and the cavity 14 is set so that the receiving surface 31 is inside the retainer installation hole 15 when the terminal 30 reaches a predetermined primary locking position at which the lance 34 of the terminal 30 is locked to the receiving portion 14A, as shown in FIG. 10. This size relationship is set with consideration of the size tolerance of each of the connector housing 10, the retainer 20, the terminal 30, and the cavity 14. The receiving surface 31 is located inside the retainer installation hole 15 regardless of whether the accumulative tolerance is a maximum at a plus side or a minus side. With reference to FIG. 8, the inclination range S of the terminal 30 on the guide surface 26 of the retainer 20 is set to cover the movable range of the receiving surface 31 based on the accumulative tolerance. Accordingly, regardless of whether the receiving surface 31 is at the plus side or the minus side, the guide surface 26 surely contacts the edge 32 of the receiving surface 31.

A substantially plate-shaped connection portion 28 extends along the outer side surface of the body 11, and is substantially continuous with one peripheral edge of the removal prevention portion. The holding pieces 22 are cantilevered sideways from the connection portion 28, and are disposed to align with the upper and lower surfaces of the body 11. Thus, the holding pieces 22 can substantially sandwich the body 11 laterally or from above and below, and can expand elastically to be apart from the body 11. A temporary locking groove 29A and a main locking groove 29B are formed on a surface of each holding piece 22, and can be locked to the locking projection 17 of the body 11.

Figure 5:
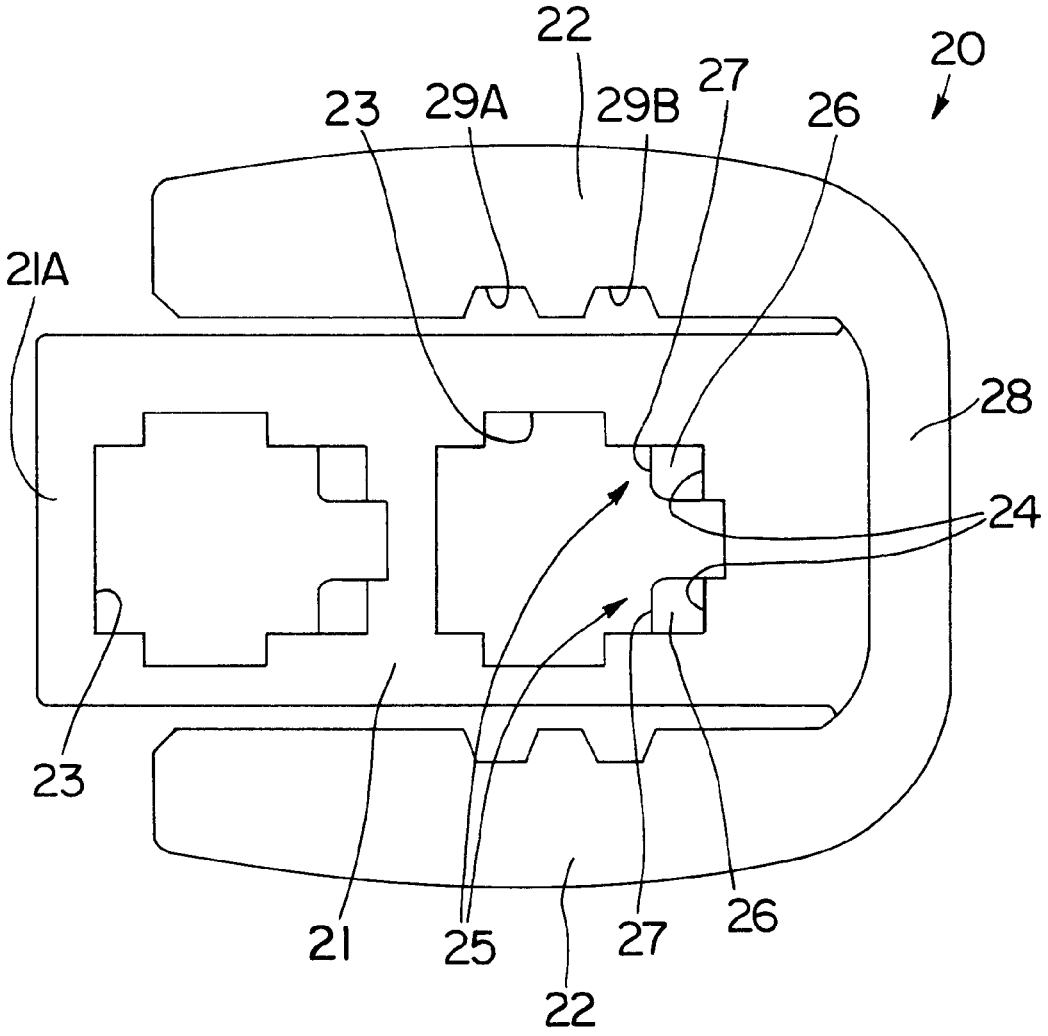
FIG. 5 is a front view showing the retainer.

Referring to FIGS. 5 and 7, the front end of the removal preventing portion 21 (which substantially extends in a direction of insertion of the retainer 20 into the housing body 11) projects substantially beyond the extending end portions of the holding pieces 22 in the insertion direction. Hence, the front end constitutes a fitting guide portion 21A that fixes or determines the position and/or orientation of the retainer 20 in the housing body 11. The guide portion 21A preferably is bevelled or slanted (FIG. 7) on preferably both edges, and thus the guide portion 21A comprises one or two slanted portions arranged at an angle different from 0°, 90° or 180° with respect to the insertion/removal direction I/R of the terminal 30. The retainer 20 approaches the side surface of the connector housing 10 during assembly, such that the front end of the removal prevention portion 21 and that of the holding piece 22 are directed forward. Thus the guide portion 21A is inserted into the retainer installation hole 15 before the front end of the holding piece 22 reaches the connector housing 10.

The holding pieces 22 have a length sufficient to extend over substantially the entire width of the upper and lower surfaces of the body 11 when the retainer 20 is locked. Additionally, the holding pieces 22 contact the front surface of the seal ring 13 when the retainer 20 is locked and prevent the seal ring 20 from being removed. Furthermore, the connection portion 28 extends along the outer side surface of the body 11 and substantially contacts the front surface of the seal ring 13 to prevent removal of the seal ring 13. The guide portion 21A at the front end of the removal prevention portion 21 projects from the side surface of the body 11 and substantially contacts the front surface of the seal ring 13 at the side of the body 11 opposite the connection portion 28 to prevent the seal ring 13 from being removed.

Figure 1:
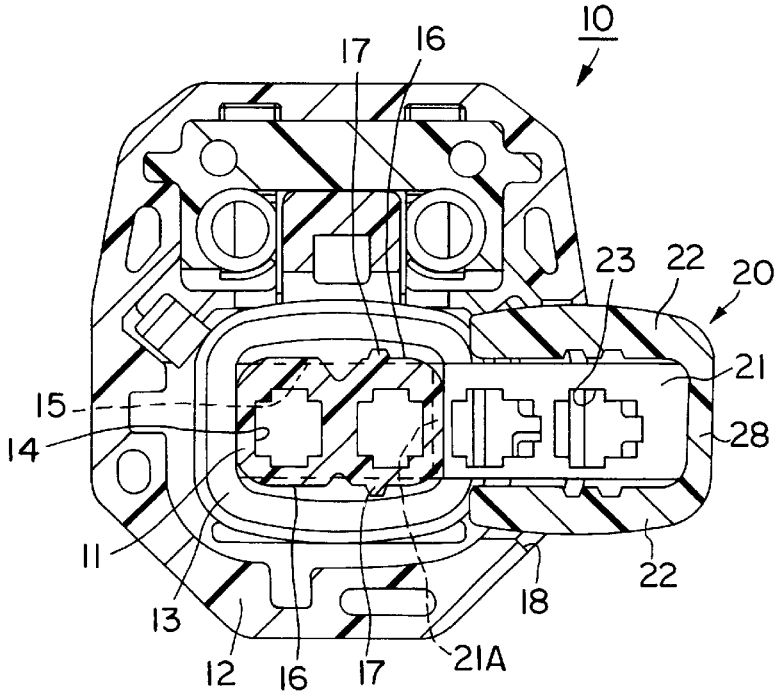
FIG. 1 is a transverse sectional view showing a state in which a retainer is starting to be installed on a connector housing in an embodiment of the present invention.
Figure 2:
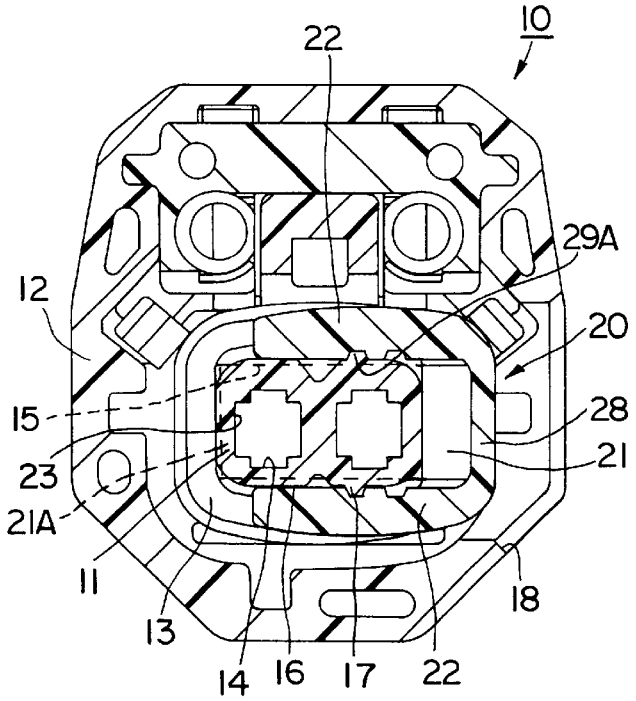
FIG. 2 is a transverse sectional view showing a state in which the retainer is temporarily locked.

The connector of this embodiment is assembled initially by temporarily locking the retainer 20 to the connector housing 10, as shown in FIG. 2. The guide portion 21A is inserted into the retainer installation hole 15 as the retainer 20 approaches the connector housing 10 and before the front end of the holding piece 22 reaches the connector housing 10 (see FIG. 1). The retainer 20 becomes positioned preferably in substantially upward/downward (or lateral) direction and substantially forward/backward (or longitudinal) direction in the connector housing 10 as the guide portion 21A is inserted into the retainer installation hole 15. As the insertion of the guide portion 21A advances further, the retainer 20 is oriented more stably with respect to substantially upward and downward (or lateral) directions and substantially forward and backward (or longitudinal) directions.

When the posture of the retainer 20 is stabilized, the front end of the holding piece 22 starts to be fitted in the guide groove 16. The holding piece 22 expands elastically and rides on the locking projection 17. When the retainer 20 reaches the temporary locking position, the holding piece 22 elastically restores towards the original posture, and the temporary locking groove 29A engages the locking projection 17. In this manner, the retainer 20 is held at the temporary locking position, as shown in FIG. 2.

In this state, the terminal 30 can be inserted into rear side of the cavity 14. The terminal 30 moves smoothly to the predetermined position inside the cavity 14 without interfering with the retainer 20, and the lance 34 of the terminal 30 is locked to the receiving portion 14A of the cavity 14. Then, the terminal 30 is pulled rearward by the operator. An inability to move the terminal 30 assures the operator that the lance 34 has achieved a reliable primary locked engagement of the terminal 30 in the receiving portion 14A of the cavity 14. When the lance 34 has been locked to the receiving portion 14A of the cavity 14, as shown in FIG. 8, the receiving surface 31 of the terminal 30 substantially faces the retainer installation hole 15 and is located in the inclination range S of the guide surface 26 of the retainer 20. If the terminal 30 has been inserted deeper than the position at which the lance 34 of the terminal 30 is locked to the receiving portion 14A, the receiving surface 31 is located either within the inclination range S or at a position forward from the inclination range S (see FIG. 11). When the receiving surface 31 is located forward of the inclination range S, the lance 34 of the terminal 30 can be locked to the receiving portion 14A by pulling the terminal 30 rearward. Thus, the function of locking the terminal primarily can be secured.

Figure 3:
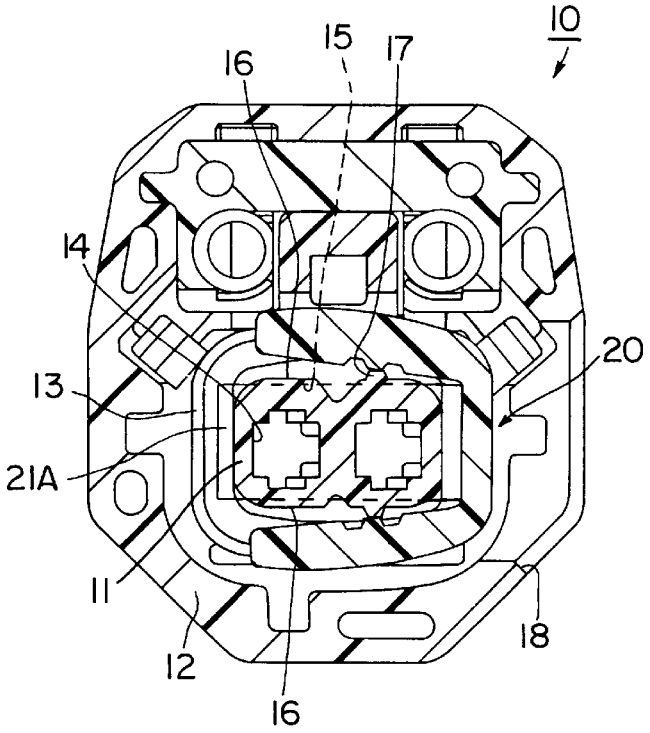
FIG. 3 is a transverse sectional view showing a state in which the retainer is moved from a temporary locking position to a locking position.
Figure 4:
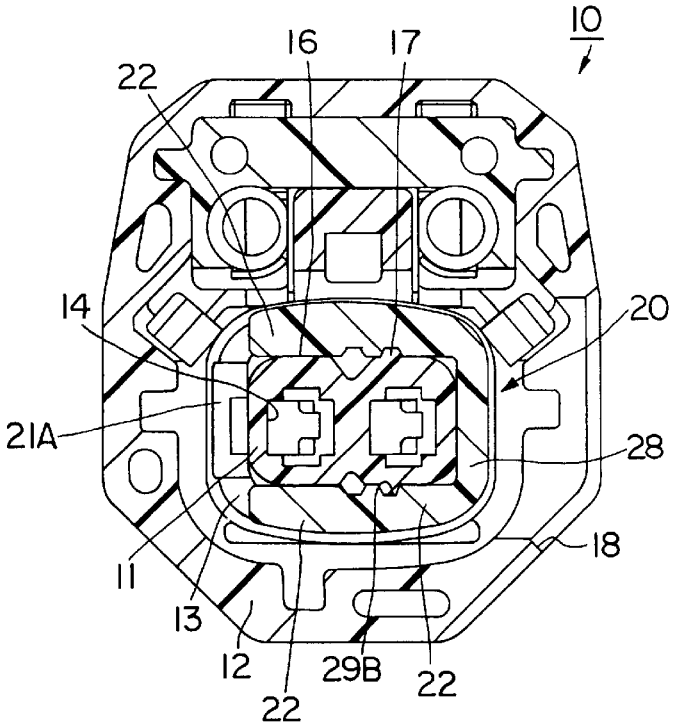
FIG. 4 is a transverse sectional view showing a state in which the retainer is locked.

Assembly proceeds by pressing the retainer 20 into the locking position. This pressing of the retainer 20 causes the holding pieces 22 to expand elastically and ride across the locking projection 17, as shown in FIG. 3. When the retainer 20 reaches the locking position, the main locking groove 29B engages the locking projection 17. In this manner, the retainer 20 is held at the locking position, as shown in FIG. 4.

The edge 32 of the receiving surface 31 of the terminal 30 is located within the inclination range S of the guide surface 26 while the retainer 20 is being pressed into the locking position. As a result, the guide surface 26 contacts the edge 32 obliquely, and the terminal 30 is pressed forward by the inclination of the guide surface 26. When the guide surface 26 is dislocated from the edge 32 of the receiving surface 31, the locking portion 24 contacts the receiving surface 31 from the rear. Consequently, the terminal 30 is locked in the secondary locking state and thus removal of the terminal 30 can be prevented reliably, as shown in FIG. 9.

Figure 12:
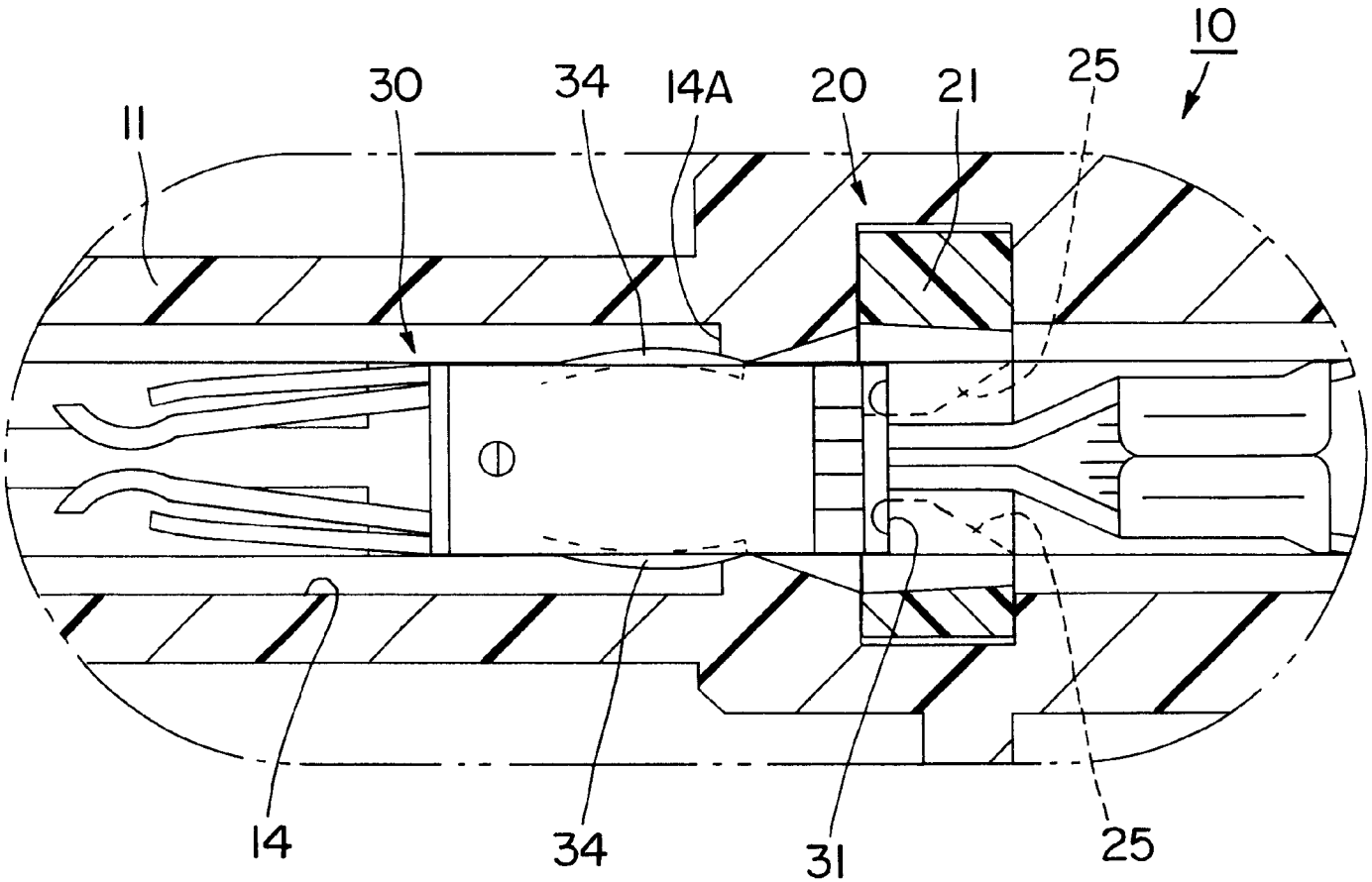
FIG. 12 is a partly enlarged horizontal sectional view showing a state in which the terminal is inserted incompletely.

As shown in FIG. 12, the terminal 30 might not be inserted into the predetermined position. In this case, when the receiving surface 31 of the terminal 30 is located within the inclination range S of the guide surface 26, the edge 32 is pressed forward by the guide surface 26 when the retainer 20 is pressed into the locking position. As a result, the terminal 30 is moved to the predetermined primary locking position. When the terminal 30 is inserted in a small amount and when the receiving surface is located rearward from the inclination range S of the guide surface 26, the contact surface 27 substantially contacts the side surface of the terminal 30. Thus, it is impossible to press the retainer 20 further toward the locking position. In this manner, the operator can determine the insertion condition of the terminal 30, i.e. whether it is correctly, sufficiently or incorrectly inserted.

When the retainer 20 is locked at the locking position, the guide portion 21A penetrates through the retainer installation hole 15 and projects on the outer surface of the connector housing 10. Thus, the retainer 20 contacts the front surface of the seal ring 13 and prevents removal of the seal ring 13. In this manner, the removal of the seal ring 13 can be prevented reliably throughout its circumference by the connection portion 28, the holding piece 22, and the guide portion 21A of the retainer.

In the embodiment described above, the guide portion 21 A is formed at the front end of the highly rigid removal prevention portion 21 of the retainer 20. The guide portion 21A engages the connector housing 10 earlier than the holding piece 22, thus placing the retainer 20 in position. Therefore, the front end of the holding piece 22 will not strike against the outer surface of the connector housing 10. Consequently, it is possible to prevent the holding piece 22 from being deformed or damaged.

The guide portion 21A is disposed at the side of the connector housing 10 opposite the side into which the retainer 20 is installed, and hence, when the retainer 20 is locked at the locking position, the guide portion 21A helps to prevent the removal of the seal ring 13. That is, the guide portion 21A performs a removal prevention function, and it is unnecessary to provide a component part dedicated for removal prevention. Therefore, it is possible to prevent the removal of the seal ring 13 reliably.

The present invention is not limited to the embodiment described with reference to the drawings, but embodiments described below are included in the technical scope of the present invention as defined in the claims. Further, embodiments described below can be made in various modes without departing from the spirit and scope of the present invention as defined in the claims.

In the embodiment, the guide portion of the retainer prevents the removal of the seal ring, but in the present invention, the guide portion may have a removal prevention function.

In the embodiment, the connector of waterproof type having the seal ring has been described. But the present invention is applicable to a connector of non-waterproof type.

What is claimed is:

1. A connector comprising a connector housing having opposite front and rear ends and at least one cavity extending between the ends and into which at least one terminal can be inserted; and a retainer which can be installed on the connector housing at a location between the opposed front and rear ends of the housing by moving the retainer transverse to the cavities to prevent removal of the terminal from the cavity;

wherein the retainer has:

a removal prevention portion which can be inserted transversely into the cavity of the connector housing and locked to the terminal in the city;

a holding piece which can be installed on the connector housing to hold the retainer at a predetermined installing position; and a guide portion formed at a front end of the removal prevention portion and projecting forward from an extended end of the holding piece in the transverse direction in which the retainer is installed on the connector housing.

2. A connector according to claim 1, wherein the holding piece is cantilevered in a direction in which the retainer is installed on the connector housing.

3. A connector according to claim 1, wherein the holding piece can be installed on an outer surface of a body of the connector housing (10).

4. A connector according to claim 1, wherein the at least one terminal can be inserted from a rear side of the connector housing.

5. A connector according to claim 1, comprising a waterproof seal ring installed on a periphery of a body of the connector housing, wherein the retainer is installed on the connector housing such that a guide portion of the retainer penetrates through the connector housing and the guide portion projects at a position of the periphery of the body of the connector housing such that the guide portion prevents removal of the seal ring.

6. A connector, comprising a connector housing having opposite front and rear ends and at least one cavity extending between the ends and into which at least one terminal can be inserted along an insertion/removal direction; and a retainer which can be installed on the connector housing along a direction transverse to the insertion/removal direction to prevent removal of the terminal;

wherein the retainer has:

a removal prevention portion which can be inserted into the connector housing and a lock portion which can be locked to the terminal in the cavity;

wherein the locking portion comprises a guide surface arranged substantially transverse to the insertion/removal direction of the terminal for engaging a receiving surface of the terminal while the retainer is being moved to its locking position thereby pressing the terminal in its insertion direction.

7. A connector according to claim 6, wherein the retainer is insertable into a retainer installing hole, and wherein the size relationship between the terminal and the cavity is set so that when the terminal reaches a predetermined primary locking position, the receiving surface is located inside the retainer installing hole.

8. A connector according to claim 7, wherein an inclination range of the terminal on the guide surface based on an accumulative tolerance of size tolerances of each of the connector housing, the retainer, the terminal and the cavity.

9. A connector according to claim 8, wherein the locking portion comprises a contact surface for engaging the terminal while the retainer is being moved to its locking position when the receiving surface of the terminal is insufficiently inserted and is located rearward from an inclination range of the guide surface.

* * * * *